US005082155A

United States Patent [19]

Salvador

[11] Patent Number: 5,082,155

[45] Date of Patent: Jan. 21, 1992

[54] SLING FOR SHOULDER-FIRED WEAPONS

[76] Inventor: Jerry A. Salvador, 300 Ortega St., San Francisco, Calif. 94122

[21] Appl. No.: 585,399

[22] Filed: Sep. 20, 1990

Related U.S. Application Data

[63] Continuation-in-part of Ser. No. 400,515, Aug. 30, 1989, abandoned, which is a continuation-in-part of Ser. No. 153,447, Feb. 8, 1988, abandoned.

[51] Int. Cl.[5] ..... F41C 33/00

[52] U.S. Cl. ..... 224/150; 224/913

[58] Field of Search ..... 224/913, 150

[56] References Cited

U.S. PATENT DOCUMENTS

| | | | |
|---|---|---|---|
| 2,357,363 | 9/1944 | Smith et al. | 224/150 |
| 2,779,521 | 1/1957 | Granberg | 224/913 |
| 4,542,840 | 9/1985 | Pepper, Sr. et al. | 224/150 |

*Primary Examiner*—Renee S. Luebke
*Attorney, Agent, or Firm*—Harold D. Messner

[57] ABSTRACT

A sling for a shoulder fired weapon is described having semi-permanent pre-adjustments to quickly accommodate both carrying and shooting modes. The sling includes: (i) a forward section attached to a forward swivel or ring of the weapon, (ii) a rear section nearest to the butt of the weapon and (iii) an anchor attached about a part of the user's body, usually his arm. The forward section is attached to the forward swivel using a hook-and-pile fastener wherein the length of the forward section is rapidly adjustable, and also includes either a male or a female quick coupler attached at a second end. The rear section is attached to the rear swivel of the weapon via a conventional buckle fastener that provides adjustments in the length of the rear section, and also includes a complementary female or male quick coupler having a recess mated to disconnectably connect to the male or female quick coupler of the forward section. The anchor is usually attached to the user's arm, and includes a complementary quick coupler matched to the complementary quick coupler of the rear section. The anchor can include various types of fasteners to effect attachment to the user. E.g., a conventional hook-pile fastener can be used in association with a ladderlock buckle to provide adjustments in the circumference of the anchor to attain a correct shooting mode for the weapon irrespective of the type of clothes worn by or the physical characteristics of the user or the amount of tension placed on the attached couplers.

20 Claims, 2 Drawing Sheets

SLING FOR SHOULDER-FIRED WEAPONS

RELATED APPLICATIONS

This application is a continuation-in-part of my copending application, Ser. No. 400,515 filed Aug. 30, 1989 which in turn was a continuation-in-part of Ser. No. 153,447 filed Feb. 8, 1988, both now abandoned.

SCOPE OF THE INVENTION

This invention relates to shoulder-fired weapons such as conventional rifles, and more specifically to an improved sling for such weapons that includes pre-use adjustments that accommodate both carrying of such weapons by the individual user as well as forms a stabilizing support for shooting the weapon.

BACKGROUND OF THE INVENTION

Heretofore, slings for shoulder-fired weapons were used to carry the weapon. When firing the weapon, the sling was either ignored (some fixed object being used to stabilize the weapon) or tension was applied to the weapon by looping the sling around the forward arm of the user (called a hasty shooting posture). While conventional slings that I am aware of, allow minor pre-use adjustments via slidable buckles, the adjustments either maximize carrying or shooting efficiency, but not both.

I am also aware of multi-piece slings and associated supports. For example, in U.S. Pat. No. 2,446,197 for "Gun-sling", F. P. Sloan, there is described a gun-sling comprising a two-piece loop linked together by a connector and thence to the muzzle and butt of the gun. The butt loop can be detached from the butt of the gun and then attached about the arm of the user to act as a stabilizing support. But the user must drastically shorten the sling before the stabilizing support can be formed, then must readjust the sling back to its original length when the sling is used to carry the gun.

In U.S. Pat. No. 4,249,686 for "Gun-sling", B. S. Morwood, there is shown a multi-piece sling that includes a loop that remains about the user's body when the sling is released from a short strap attached to the gun barrel. However, there is not a stabilizing support for the user after the sling is released.

In U.S. Pat. No. 2,481,884, for "Combination Arm Band and Rifle Sling", M. K. Short, there is illustrated a slidable single-piece sling which includes a hook permanently affixed to the sling between two fastening means. A separate arm band with an attached eye-loop, extends around the arm of the user. When used as a firing support, the sling remains fixed as one unit. The user manipulates the sling in forward movement (in a jabbing motion) relative to his body to a position such that the hook can slide into contact with the eye-loop. Then further movement causes the arm band to elongate in the forward direction while tightening the band about the arm. Since the sling remains as a single attached unit, the amount of elongation of the arm band cannot be easily adjusted when the weapon is in a firing position. Removal of the hook of the sling is by a jab of the weapon to the rearward where the weapon is positioned near to the body of the user where the tautness of the single unit strap releases the eye-loop of the arm band.

SUMMARY OF THE INVENTION

A sling for a shoulder fired weapon is described having semi-permanent pre-adjustments to quickly accommodate both carrying and shooting modes. The sling includes: (i) a forward section attached to a forward swivel or ring of the weapon, (ii) a rear section nearest to the butt of the weapon and (iii) an anchor means attached about a part of the user's body, usually his arm.

The forward section is attached to the forward swivel using a hook-and-pile fastener wherein the length of the forward section is rapidly adjustable, and also includes either a male or a female quick coupler attached at a second end. The rear section is attached to the rear swivel of the weapon via a conventional buckle fastener that provides adjustments in the length of the rear section, and also includes a complementary female or male quick coupler employed to disconnectably connect to the male or female quick coupler of the forward section.

The anchor means is usually attached to the user's arm, and includes a complementary quick coupler matched to the complementary quick coupler of the rear section. The anchor means can include various types of fasteners to effect attachment to the user. For example, a conventional hook-pile fastener can be used in association with a ladderlock buckle to provide adjustments in the circumference of the anchor to attain a correct shooting mode for the weapon irrespective of the type of clothes worn by the user, his physical characteristics or the amount of tension placed on the attached couplers in the shooting mode.

In operation, since the complementary quick couplers are substantially identical and are independently operative with respect to the male or female quick coupler of the forward section, the user can rapidly disconnect and re-connect the quick couplers together to quickly and easily change the operating mode of the sling, say from a carrying to a shooting mode or vice versa, irrespective of the user's physical characteristics. That is, the user can correctly adjust the sling to accommodate shooting and carrying modes in semi-permanent fashion before the weapon is actually used in field operations.

Still further, in the shooting mode the rear section of the sling is permitted to fall out of the user's way as the improved stabilizing support for the weapon is attained by eliminating the possibility of transferring tension to the user via the butt of the weapon through the rear section of the sling.

Assuming the user is standing, sitting or prone relative to the earth's surface and a horizontal plane is attained through the weapon, a triangular support of surprising stability is defined wherein the three side are: (i) the forward section of the sling including the engaged male-female quick couplers at the arm anchor, (ii) the upper body of the user between his shoulders, and (iii) thence along the weapon itself. Minuscule tension is applied through the butt of the weapon via the rear section attached thereto.

DESCRIPTION OF AN EMBODIMENT OF THE INVENTION

Figure 1:
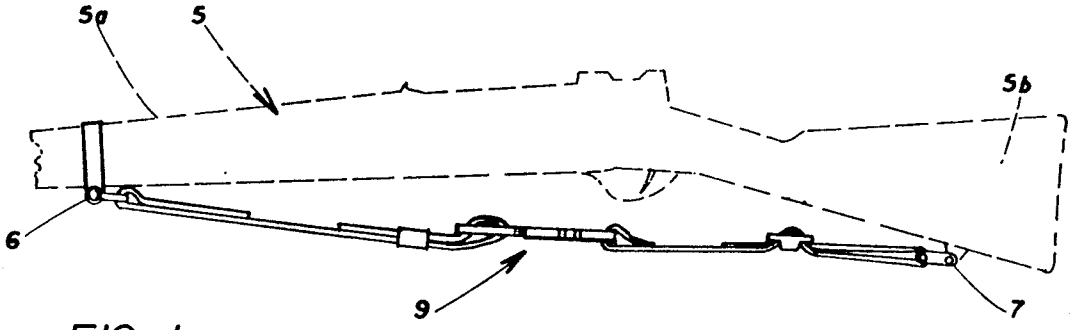
FIG. 1 is a side elevation view of a rifle having the sling of the present invention attached in a carrying mode.

FIG. 1 shows a standard military rifle 5 having a sling swivel 6 on forestock 5*a* of rifle 5 and a butt swivel 7 on the buttstock 5*b*. Attached to the sling and butt swivels 6, 7 are two-pieces of sling 9 of the invention in use as a parade sling. In such use, the sling is drawn taut to permit the user to grasp rifle 5 in the usual military close-arm rifle drills.

While FIG. 1 shows sling 9 in association with military rifle 5, other types of weapons could be substituted without departing from the intended scope of use of the invention. For example, the sling 9 of the invention could also be used with sport and police weapons conventional in the art.

Figure 2:
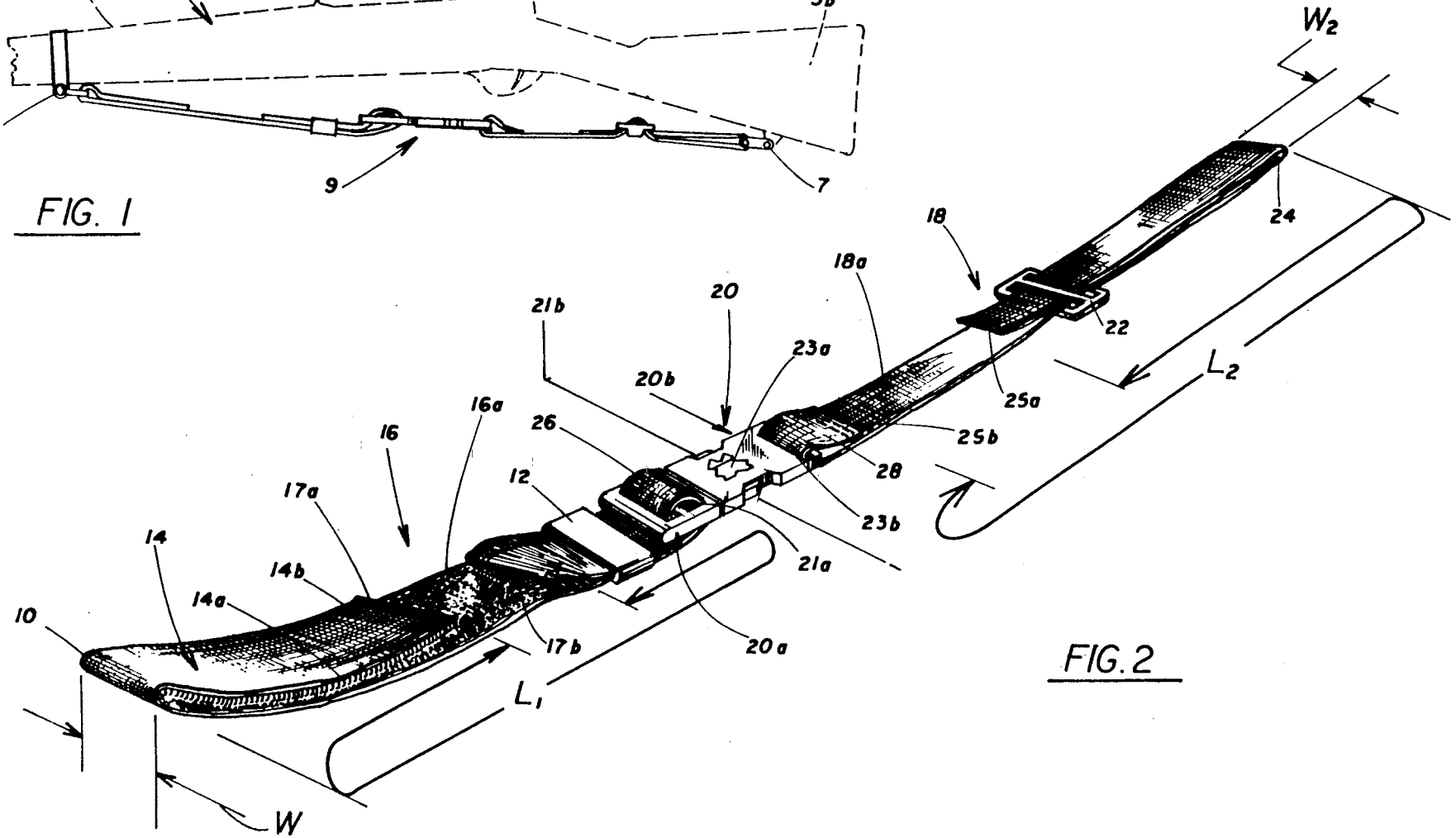
FIG. 2 is a detail of the carrying sling of FIG. 1 in perspective view detached from the rifle.

FIG. 2 shows the two-pieces of the sling 9 of FIG. 1 detached from the rifle 5. As shown, the two pieces comprise a forward section 16 and a rearward section 18. Forward section 16 includes a webbing segment or strap 16*a* that can be formed of any conventional material used to construct military-type slings such as nylon and has an overall length L1 of about 30 inches and a width W of about 1½ inches. Where the segment 16*a* connects to the sling swivel 6 in FIG. 1, is a fold 10. About the fold 10 is a fastener 14 comprising a hook section 14*a* and a pile section 14*b*.

Assuming the swivel 6 of FIG. 1 is located at fold 10, the hook section 14*a* extends to and terminates at free near end 17*a* of the segment 16*a* and has a length of about 10 inches in a preferred embodiment. The pile section 14*b* extends from the fold 10 towards far end 17*b* of the segment 16 and also has a length of about 10 inches in the preferred form of the invention. Near the far end 17*b* of the segment 16*a*, such segment 16*a* is seen to be looped back upon itself and secured by an elastic keeper 12. Such looping is aided by passing the segment 16*a* through an opening 21*a* within a male coupler 20*a*. Such male coupler 20*a*, in turn, has a bayonet portion 21*b* attachable and receivable within a female coupler 20*b* of rearward section 18.

The male coupler 20*a* is of a type known in the art as a quick coupler that disconnectably connects within housing 23*a* of the female coupler 20*b*. The male and female coupler is 20*a*, 20*b* together form a disconnectable connector generally indicated at 20. Such connectors 20 can be purchased under the tradename such as FASTEX, MODEL SR-1.5 from the Fastex Corporation, and are generally, together, referred to in the art as quick couplers or connectors.

Rearward section 18 includes a webbing segment or strap 18*a* that can be formed of similar type material as segment 16*a* of forward section 16, viz., such as nylon and has similar overall dimensions matched to those of the latter. That is, the segment 18*a* has an length L2 of about 30 inches and a width W2 of about 1 and ½ inches. Where the segment 18*a* connects to the butt swivel 7 in FIG. 1, is a fold 24. From the fold 24, the segment 18*a* folds back on itself and is threaded through a ladderlock buckle 22 adjacent to terminating end 25*a*. At its opposite end, the segment 18*a* is seen to be looped back upon itself after passing through opening 23*b* in the female coupler 20*b* and then is secured by a series of threads 28 sewn to the webbing segment 18*a* near terminating end 25*b*.

Figure 4:
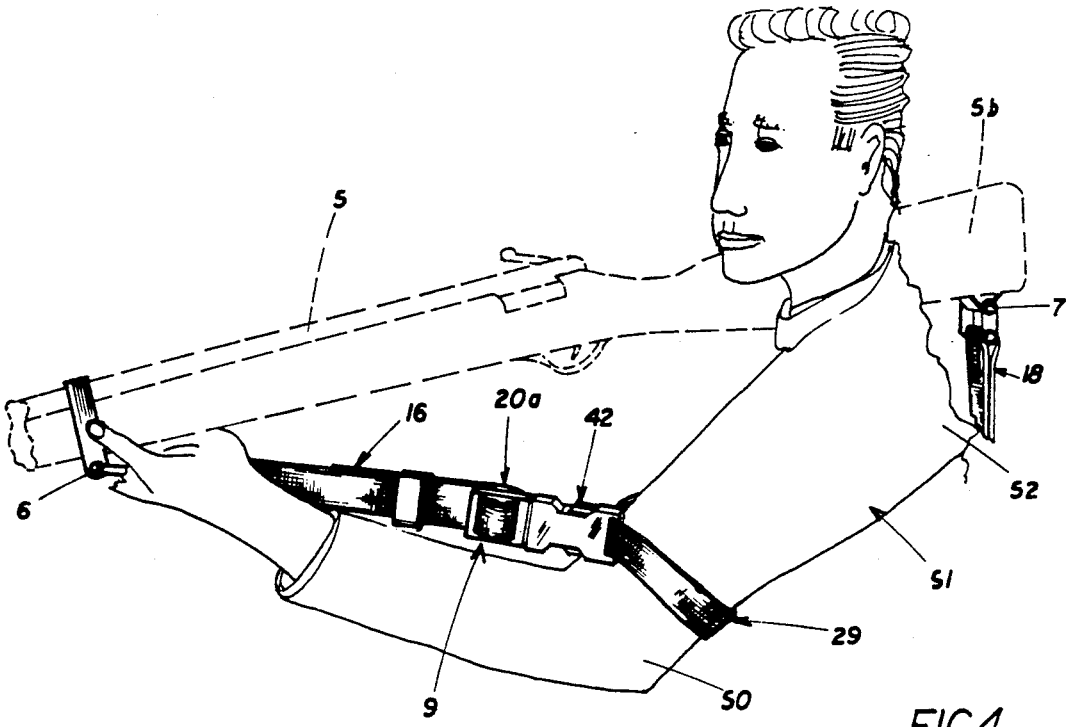
FIG. 4 is a perspective view of the sling of the present invention in use in the shooting mode.
Figure 3:
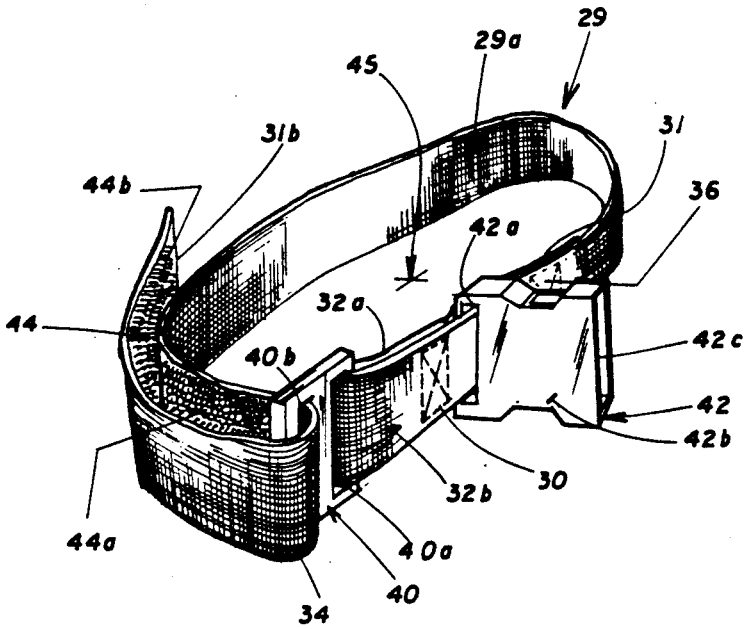
FIG. 3 is a detail of the arm anchor of the sling of the present invention that is worn by the user, in perspective view.

FIGS. 3 and 4 illustrate the third piece of the sling 9 in more detail.

As shown in FIG. 3, the third piece comprises an anchor generally indicated at 29 comprising a webbing segment or strap 29*a* of the same material used to form segments 16*a* and 18*a* of FIGS. 1 and 2. The segment 29*a* also has a fixed end 31*a* and a folded section 32*a* that passes back upon a coextensive section 32*b* via opening 40*a* of ladderlock buckle 40. The folded section 32*a* is attached to aforementioned coextensive section 32*b* via a series of threads indicated at 30 and 36 sewn unto, through and about the aligned sections 32*a*, 32*b* to permanently affix them together. The folded section 32*a* terminates at end 31*a*.

Between the sewn sections defined by threads 30, 36 is a female coupler 42. The coupler 42 is similar to female coupler 20*b* of FIGS. 1 and 2. The coupler 42 includes an opening 42*a* through which coextensive section 32*b* extends (but not folded section 32*a*), and a housing 42*b* having a recess 42*c* that disconnectably connects to male coupler 20*a* as shown and explained in detail with reference to FIG. 4.

Opposite to its region of attachment to female coupler 42, the segment 29*a* is seen to pass through an opening 40*b* of the ladderlock buckle 40 and then is folded back upon itself (thus defining fold 34) and terminates at free end 31*b*. That is, where the segment 29*a* connects to the ladderlock buckle 40 defines the position of the fold 34. Adjacent to the fold 34 is a fastener 44 comprising a hook section 44*a* and a pile section 44*b*.

Assuming the left arm 50 of the user 51 of FIG. 4 is located within interior 45 of the arm anchor 29, the hook section 44*a* is attached to the webbing segment 29*a* on the same side as from which housing 42*b* of female coupler 42 extends. The hook section 44*a* begins adjacent to the end 31*a* of the webbing segment 29*a*, terminates near fold 34 and has a length of about 10 inches in a preferred embodiment. The pile section 44*b* starts where hook section 44*a* ends (approximately adjacent to fold 34) and terminates at end 31*b*.

FIG. 4 shows the sling 9 of the invention being used by user 51 in a shooting mode. Note that first the user 51 must disconnect the female coupler 20*b* (FIG. 2) of the quick connector 20 from the male coupler 20*a* and then attach the male coupler 20*a* to the female coupler 42 of the anchor 29. The female coupler 20*b* along with the remainder of the elements comprising the rearward section 18 fall away from the user 51 but remain attached to the butt swivel 7 as shown.

Next, the user 51 adjusts the length of the forward section 16 to create as much tension as practical between the connected couplers 20*a*, 42 and the front swivel 6. This is easily achieved by the user 51 using his trigger hand (not shown) to alternatively disconnect and re-connect the hook/pile fastener 14 (FIG. 2) relative to the front swivel 6 until a correct shooting support position is attained.

Prior to attaching the male coupler 20*a* to the female coupler 42, the user 51 extends his arm 50 into the anchor 29 and secures the latter to his arm 50 by alternating alternatively disconnecting and re-connecting the hook/pile fastener 44 (FIG. 3) until a snug fit is attained. Note that the female coupler 42 is positioned as close to shoulder 52 as is comfortable and extends outward from the arm 50 toward the front swivel 6 of the rifle 5.

Assuming the user 51 is standing, sitting or prone relative to the earth's surface and a horizontal plane is attained through the rifle 5, a triangular support of surprising stability is defined wherein the three side are: (i) the forward section 16 of the sling 9 including the engaged male-female quick couplers 20*a*, 42 at the anchor 29, (ii) the upper body of the user 51 between his shoulders 52, and (iii) the thence along the rifle 5. Minuscule tension is applied through the butt 5*b* of the rifle 5 since the rearward section 18 falls away from the user 51 but remains attached to the butt swivel 7 at one end only, as shown.

To return the sling 9 of the invention to a carry mode, the user 51 would disconnect the male coupler 20*a* from the female coupler 42 and then re-connect the former to the female coupler 20*b* of the rearward section 18 of FIG. 2. To achieve the correct length for the sling in the carry mode, whether it be a parade sling of FIG. 1, a over-the-shoulder or over-the-chest sling, the user would make only a length change in the rearward section 18 using ladderlock buckle 22 to lengthen or shorten the overall length of the sling 9.

The above description contains an embodiment of the invention. It is not intended that such be construed as limitations on the scope of the invention, but merely as an example of preferred the embodiment. Persons skilled in the art can envision other obvious possible variations within the scope of the description. For example, the anchor 29 of FIG. 3 can be used by left-handed users by reversing the entry of the arm through the interior 45 of the anchor 29. Furthermore, the anchor 29 can also be lengthened to fit around the chest of the user. Hence heavy weapons can be fired with extreme accuracy. Still futher, either a male or a female coupler could be permanently attached to the forward section 16 of the sling 9 so long as a complementary coupler is used to disconnectably receive such male or female coupler. That is, if the forward section includes a male quick coupler, then the rear and arm anchor must be complementary female quick couplers. But if the forward section includes a female quick coupler, then the rear and arm anchor must include complementary male quick couplers only. Still further, snaps could be added to the hook-pile fasteners if needed under field conditions. Hence the scope of the invention is to be determined by the appended claims and their legal equivalents.

What is claimed is:

1. A sling for a shoulder fired weapon in which there are pre-adjustments to quickly accommodate both carrying and shooting modes of said weapon for an individual user, said weapon including a forward swivel and a rear swivel, comprising a forward section having a first strap means, a forward fastener connected to said first strap means for attaching said forward section to a forward swivel of a weapon and one of a male and female quick coupler attached to said first strap means, said forward fastener providing relatively large numbers of adjustments in length of said forward section in a rapid manner to provide for a shooting mode for said weapon, a rear section having a second strap means, a rear fastener for attaching said rear section to a rear swivel of said weapon and a complementary one of a female and male quick coupler attached adjacent to a second end thereof, said rear fastener providing for adjustments in length of said rear section to provide a carrying mode for said weapon, anchoring means attached to a user's body and including a third strap means as well as another complementary one of a female and male quick coupler attached to said third strap means and a loop adjustable fastener also attached to said third strap means, said loop adjustable fastener permitting change of length of said anchoring means in rapid manner, said complementary one of a male and female coupler and said another complementary one of a female and male quick coupler being substantially identical whereby said forward section can be disconnectably connected to said rear section defining said carrying mode of said weapon and can be disconnectably connected to said anchoring means to define said shooting mode of said weapon, wherein during said shooting mode said rear section falls away from a user of said weapon but remains attached to said rear swivel of said weapon.

2. The sling of claim 1 in which said loop adjustable fastener of said anchoring means includes a hook-pile fastener adjacent a first end of said third strap means, and a ladderlock buckle adjacent a second end of said third strap means, said hook-pile fastener being inserted within and loopable about an opening in said ladderlock buckle to permit change in length of said anchoring means for attachment to a portion of said user's body.

3. The sling of claim 1 in which said carrying mode is accommodated by connecting said one of male and female quick coupler of said forward section with said complementary one of a female and male quick coupler of said rear section wherein said rear fastener attached to said rear section can be activated to provide for relatively large numbers of adjustments in length of said rear section relative to said rear swivel of said weapon, to establish a comfortable carrying mode for said weapon relative to said individual user regardless of physical characteristics of said user.

4. The sling of claim 1 in which said forward fastener of said forward section is a hook-pile fastener.

5. The sling of claim 4 in which said shooting mode is accommodated by connecting said one of male and female quick coupler of said forward section with said another complementary one of a female and male quick coupler of said anchoring means thereby permitting said rear section to fall away from said user, said hook-pile fastener of said forward section being capable of effecting rapid changes in the length of said forward section by detaching and then re-attaching same relative to said forward swivel of said weapon, to establish in a rapid manner a rigid shooting support for said weapon relative to said individual user irrespective of shooting position and physical characteristics of said user.

6. A sling for a shoulder fired weapon in which there are pre-adjustments to quickly accommodate both carrying and shooting modes for an individual user, said weapon including a forward swivel and a rear swivel, comprising a forward section attached to a forward swivel of a weapon, said forward section including a first strap means and a male quick coupler attached to said strap means remote from said forward swivel, a rear section attached to a rear swivel of said weapon, said rear section including a second strap means and a first female quick coupler attached to said second strap means remote from said rear swivel, anchoring means attached to and about a user's body, said anchoring means including a third strap means and a second female quick coupler attached to said third strap means, said first and second female quick couplers being substantially identical whereby said forward section can be disconnectably connected to one of said rear section and said anchoring means whereby at least said rear section is permitted to fall out of the user's way when a shooting mode for said weapon relative to an individual user, is attained.

7. The sling of claim 6 in which said forward section and said anchoring means each include fastener means that permit changes in length of said forward section and said anchoring means, respectively.

8. The sling of claim 7 in which said fastener means of said forward section and said anchoring means, are both hook-pile type fasteners.

9. The sling of claim 8 in which said shooting mode is accommodated by connecting said male quick coupler of said forward section with said second female quick coupler of said anchoring means, said hook-pile fastener of said forward section being capable of rapidly changing the length of said forward section by detaching and re-attaching same relative to said forward swivel thereby establishing a rigid shooting support for said weapon regardless of shooting position and physical characteristics of said user, in a rapid manner.

10. The sling of claim 8 in which said carrying mode is accommodated by insertion of said male quick coupler of said forward section into contact with said first female quick coupler of said rear section, said rear section including a second fastener attached to said rear section capable of effecting changes in the length of said rear section relative to said rearward swivel of said weapon to provide for relatively large numbers of adjustments in length of said rear section relative to said forward section, and thereby establish a comfortable carrying mode for said weapon relative to said individual user regardless of physical characteristics of said user.

11. A sling for a shoulder fired weapon in which there are pre-adjustments to quickly accommodate both carrying and shooting modes for an individual user, said weapon including a forward swivel and a rear swivel, comprising a forward section attached to a forward swivel of a weapon, said forward section including a first strap means and a female quick coupler attached to said strap means remote from said forward swivel, a rear section attached to a rear swivel of said weapon, said rear section including a second strap means and a first male quick coupler attached to said second strap means remote from said rear swivel, anchoring means attached to and about a user's body, said anchoring means including a third strap means and a second male quick coupler attached to said third strap means, said first and second male quick couplers being substantially identical whereby said forward section can be disconnectably connected to one of said rear section and said anchoring means to rapidly attain either a carrying or a shooting mode for said weapon whereby in said shooting mode said rear section is permitted to fall out of the user's way.

12. The sling of claim 11 in which said carrying mode is accommodated by connecting said female quick coupler of said forward section with said first male quick coupler of said rear section and wherein said rear member also includes rear fastener means capable of changing the length of said rear section relative to said rearward swivel of said weapon and thereby establishing a comfortable carrying mode for said weapon relatively to said individual user regardless of physical characteristics of said user.

13. The sling of claim 11 in which said forward section and said anchoring means each include fastener means that permit rapid changes in length of said forward section and said anchoring means, respectively.

14. The sling of claim 13 in which said fastener means of said forward section and said anchoring means, are both hook-pile type fasteners.

15. The sling of claim 14 in which said shooting mode is accommodated by connecting said female quick coupler of said forward section with said second male quick coupler of said anchoring means, said hook-pile fastener of said forward section being capable of changing the length of said forward section by detaching and then re-attaching same relative to said forward swivel of said weapon thereby to establish a rigid shooting support for said weapon regardless of shooting position and physical characteristics of said user, in a rapid manner.

16. A method of making a series of pre-adjustments to a sling for a shoulder-fired weapon to quickly accommodate both carrying and shooting modes for an individual user, said weapon including a forward swivel and a rear swivel, comprising (i) attaching forward and rearward sections of a sling to forward and rear swivels of a weapon, said forward section including a first strap means and one of a male and female quick coupler attached to said strap mean remote from said forward swivel, said rear section including a second strap means and a first complementary female or male quick coupler attached to said second strap means remote from said rear swivel, said complementary female or male coupler being opposite in function to that of said one male or female quick coupler attached to said forward section, (ii) attaching anchoring means to and about a part of a user's body, said anchoring means including a third strap means and a second complementary female or male quick coupler attached to said third strap means wherein said first and second complementary quick couplers are substantially identical, (iii) establishing shooting and carrying modes for said weapon by disconnectably connecting said one quick coupler of said forward section to one of said first and second complementary quick couplers of said anchoring means and said rear section, respectively, while making adjustments in length of said forward and rear sections, said shooting mode being characterized by said rear section falling out of the user's way but remaining attached to said rear swivel of said weapon.

17. The method of claim 16 in which step (iii) also includes the substeps of changing the lengths of said forward section and said anchoring means, using first and second fastener means that facilitate such changes in length of said forward section and said anchoring mean, respectively, wherein said first and second fastener means are both hook-pile type fasteners.

18. The method of claim 17 in which said shooting mode of step (iii) is accommodated by disconnectably connecting said one quick coupler of said forward section with said second complementary quick coupler of said anchoring means, detaching and then re-attaching said hook-pile fastener of said forward section relative to said forward swivel of said weapon to change, under tension, the length of said forward section thereby to establish a rigid shooting support for said weapon relative to said individual user regardless of shooting position and physical characteristics of said user, in a rapid manner.

19. The method of claim 17 in which said carrying mode of step (iii) is accommodated by connecting said one quick coupler of said forward section with said first complementary quick coupler of said rear section and adjusting the length of the rear section using an adjustable fastening means.

20. The method of claim 19 wherein the adjustable fastening means of said rear section adjustably secures said rear member relative to said rear swivel of said weapon, said fastener means also being capable of changing the length of said rear section relative to said rearward swivel of said weapon to provide for relatively large numbers of adjustments in length and thereby establish a comfortable carrying mode for said weapon relative to said individual user regardless of physical characteristics of said user.

* * * * *